US011326850B2

(12) United States Patent
Petersen

(10) Patent No.: US 11,326,850 B2
(45) **Date of Patent: *May 10, 2022**

(54) SUPPRESSOR WITH BLOWOUT PANEL

(71) Applicant: DELTA P DESIGN, INC., Walterville, OR (US)

(72) Inventor: Byron S. Petersen, Springfield, OR (US)

(73) Assignee: Delta P Design, Inc., Walterville, OR (US)

( * ) Notice: Subject to any disclaimer, the term of this patent is extended or adjusted under 35 U.S.C. 154(b) by 28 days.

This patent is subject to a terminal disclaimer.

(21) Appl. No.: 17/114,239

(22) Filed: Dec. 7, 2020

(65) Prior Publication Data

US 2021/0348868 A1 Nov. 11, 2021

Related U.S. Application Data

(62) Division of application No. 16/255,471, filed on Jan. 23, 2019, now Pat. No. 10,890,403.

(60) Provisional application No. 62/620,928, filed on Jan. 23, 2018.

(51) Int. Cl.

| | |
|---|---|
| ***F41A 21/30*** | (2006.01) |
| ***F41A 21/32*** | (2006.01) |
| *F41A 21/02* | (2006.01) |

(52) U.S. Cl.

CPC ..... *F41A 21/30* (2013.01); *F41A 21/02* (2013.01)

(58) Field of Classification Search

CPC ..... F41A 21/30; F41A 21/32; F41A 21/36

See application file for complete search history.

(56) References Cited

U.S. PATENT DOCUMENTS

| | | | | | |
|---|---|---|---|---|---|
| 812,140 | A * | 2/1906 | Kent | F41A 21/28 | 89/14.3 |
| 880,386 | A * | 2/1908 | Maxim | F41A 21/30 | 89/14.05 |
| 984,890 | A * | 2/1911 | Dudderar | F01N 1/08 | 181/255 |
| 1,143,814 | A * | 6/1915 | De Vries | F41A 21/30 | 89/14.4 |
| 1,207,264 | A * | 12/1916 | Bailey | F41A 21/30 | 89/14.4 |
| 1,763,286 | A * | 6/1930 | Wilman | F41A 21/30 | 89/14.3 |
| 1,773,443 | A * | 8/1930 | Wilman | F41A 21/30 | 89/14.4 |
| 1,877,118 | A * | 9/1932 | Barnes | F41A 25/02 | 126/41 R |
| 1,901,138 | A * | 3/1933 | Barnes | F41A 21/30 | 89/14.3 |
| 2,208,093 | A * | 7/1940 | Brown | F41A 21/30 | 89/14.4 |
| 2,449,571 | A * | 9/1948 | Walker | F41A 21/30 | 89/14.4 |

(Continued)

*Primary Examiner* — Derrick R Morgan

(74) *Attorney, Agent, or Firm* — McCoy Russell LLP

(57) ABSTRACT

Methods and systems are provided for a firearms suppressor adapted with blowout panels. In one example, the blowout panels may be configured to have a lower tolerance for pressure than the materials from which outer components of the suppressor are formed. During over pressure events of the suppressor, the blowout panels may rupture, thereby dissipating pressure in the suppressor.

19 Claims, 6 Drawing Sheets

(56) References Cited

U.S. PATENT DOCUMENTS 3,267,662 A * 8/1966 Miller ..... F42B 39/20 220/261
3,272,074 A * 9/1966 Vinson ..... F41A 21/34 144/144.1
3,500,955 A * 3/1970 Werbell ..... F41A 21/30 181/223
3,667,570 A * 6/1972 WerBell, III ..... F41A 21/30 89/14.4
3,710,679 A * 1/1973 Werbell, III ..... F41A 21/30 89/14.4
3,952,629 A * 4/1976 Boccarossa ..... F41A 21/30 89/14.4
4,203,347 A * 5/1980 Pinson ..... F41A 1/08 89/1.816
4,505,180 A * 3/1985 Hinrichs ..... F02K 9/38 220/89.2
5,811,713 A * 9/1998 Gudgel ..... F41C 27/00 42/105
7,237,353 B1 * 7/2007 Beauchamp ..... F41A 21/36 89/14.6
7,252,079 B1 * 8/2007 Walker ..... F41B 11/681 124/71
7,325,495 B1 * 2/2008 Giandomenico ..... F41H 9/10 102/370
7,472,653 B1 * 1/2009 Hays ..... F42B 39/20 102/481
8,459,405 B1 * 6/2013 Dueck ..... F41A 21/34 89/14.4
8,474,361 B2 * 7/2013 Brittingham ..... F41A 21/30 89/14.7
9,733,035 B2 * 8/2017 Davis ..... F41A 21/34
9,816,773 B1 * 11/2017 Reis Green ..... F41A 21/30
10,107,581 B2 * 10/2018 Garst ..... F41A 21/30
10,145,636 B2 * 12/2018 Stark ..... F16K 47/08
10,281,228 B1 * 5/2019 Marfione ..... F41A 21/30
10,330,419 B1 * 6/2019 Holderby ..... F41A 21/30
10,809,032 B1 * 10/2020 Thomas ..... F41A 21/44
2007/0107590 A1 * 5/2007 Silvers ..... F41A 21/34 89/14.4
2008/0148928 A1 * 6/2008 McClellan ..... F41A 21/30 89/14.4
2009/0139795 A1 * 6/2009 Brittingham ..... F41A 21/30 181/223
2010/0175763 A1 * 7/2010 Newman ..... F41B 11/723 137/505.42
2010/0180759 A1 * 7/2010 Petersen ..... F41A 21/30 89/14.4
2011/0056111 A1 * 3/2011 Brittingham ..... F41A 21/30 29/557
2012/0103176 A1 * 5/2012 Latka ..... F41A 21/325 89/14.4
2012/0152649 A1 * 6/2012 Larue ..... F41A 21/36 181/223
2013/0180797 A1 * 7/2013 Dueck ..... F41A 21/325 181/296
2014/0137452 A1 * 5/2014 Coleman ..... F41A 21/36 42/1.06
2014/0299405 A1 * 10/2014 Miller ..... F41A 21/30 181/223
2015/0027333 A1 * 1/2015 Bliss ..... F42B 39/18 86/47
2015/0136519 A1 * 5/2015 Moore ..... F41A 21/30 181/223
2015/0338183 A1 * 11/2015 Salvador ..... F41A 21/30 181/223
2016/0084597 A1 * 3/2016 Ricks ..... F41A 5/28 89/193
2016/0209152 A1 * 7/2016 Dueck ..... F41A 21/30
2017/0146312 A1 5/2017 Groves
2017/0160036 A1 * 6/2017 Walker ..... F41A 21/36
2017/0205176 A1 * 7/2017 Whitson ..... F41A 21/325
2018/0156553 A1 * 6/2018 Rode ..... F41A 5/20
2018/0202743 A1 * 7/2018 Stark ..... F41A 21/30
2019/0063859 A1 * 2/2019 Gilpin ..... F41A 21/30
2019/0170460 A1 * 6/2019 Kingsbury ..... F41A 5/26
2019/0257607 A1 * 8/2019 Dobrinescu ..... F41A 21/30
2019/0353446 A1 * 11/2019 Kras ..... F41A 21/325
2020/0263947 A1 * 8/2020 Calderwood ..... F41A 21/36

* cited by examiner

SUPPRESSOR WITH BLOWOUT PANEL

CROSS REFERENCE TO RELATED APPLICATION

The present application is a divisional application which claims priority to U.S. Utility application Ser. No. 16/255,471, entitled "SUPPRESSOR WITH BLOWOUT PANEL", and filed Jan. 23, 2019. Application Ser. No. 16/255,471 claims priority to U.S. Provisional Application No. 62/620,928, entitled "SUPPRESSOR WITH BLOWOUT PANEL", and filed on Jan. 23, 2018. The entire contents of the above-listed applications are hereby incorporated by reference for all purposes.

FIELD

The present description relates generally to methods and systems for firearms sound suppressors adapted with a blowout panel.

BACKGROUND AND SUMMARY

Firearms utilize high pressure exhaust gases to accelerate a projectile such as a bullet. Firearms silencers (hereafter referred to as "suppressors") can be added to the muzzle (exhaust) of a firearm to capture the high pressure exhaust gases of a given firearm. These high pressure exhaust gases are the product of burning nitrocellulose and possess significant energy that is used to accelerate the projectile. The typical exhaust gas pressure of a rifle cartridge in a full length barrel may be in the range of 7-10 ksi whereas a short barreled rifle may have exhaust gas pressures in the 10-20 ksi range. Moving at supersonic speeds through the bore, the exhaust gases provide the energy to launch the projectile and also result in the emanation of high-decibel noises typically associated with the discharge of firearms. When in action, firearms suppressors lower the kinetic energy and pressure of the propellant gases and thereby reduce the decibel level of the resultant noises.

Firearms suppressors are mechanical pressure reduction devices that contain a center through-hole to allow passage of the projectile. Suppressor design(s) utilize static geometry to induce pressure loss across the device by means including rapid expansion and contraction, minor losses related to inlet and outlet geometry, and induced pressure differential to divert linear flow.

Suppressors can be thought of as "in-line" pressure reduction devices that capture and release the high pressure gases over a time. Suppressor design approaches used to optimize firearm noise reduction include maximizing internal volume, and providing a baffled or "tortured" pathway for propellant gas egress. Each of these approaches must be balanced against the need for clear egress of the projectile, market demand for small overall suppressor size, adverse impacts on the firearm performance, adverse impacts on the operator, and constraints related to the firearm original mechanical design.

Baffle structures within a suppressor provide tortured pathways which act to restrain the flow of propellant gases and thereby reduce the energy signature of said gases. As a result of this function the baffle structures in a suppressor may be the portion of a suppressor that absorbs the most heat from propellant gases during firing. While the baffle structures are often positioned spaced away from an outer housing of the suppressor to minimize heat transfer from the baffle structures to the exterior surface of the suppressor, the outer housing may nonetheless be subjected to high temperatures over numerous firings of the firearm. Thus, the suppressor may be formed from a material with high heat tolerance to withstand temperatures approaching 1000° C. that are generated during firearm discharge.

Suppressors may be coupled to auto-loading firearms, both semi-automatic and automatic, which are configured to utilize a portion of the waste exhaust gases to operate the mechanical action of the firearms. When in operation the mechanical action of the firearm automatically ejects the spent cartridge case and emplaces a new cartridge case into the chamber of the firearms barrel. One auto-loading design traps and utilizes exhaust gases from a point along the firearms barrel. The trapped gases provide pressure against the face of a piston, which in turn triggers the mechanical auto-loading action of the firearm. The energy of the trapped exhaust gases supplies the work required to operate the mechanical piston of the firearm enabling rapid cycling of cartridges.

The inventors herein have recognized significant issues related to excess heat and exhaust gas pressure build-up that may arise due to the use of a suppressor on a firearm. In one example, the suppressor may experience high temperatures repeatedly at both the inner baffle structures and the outer housing. Over extended periods of time and usage, exposure to high heat may reduce the structural integrity of the suppressor with regards to withstanding the pressures and temperatures generated during firearm discharge. Degradation to the suppressor outer housing may lead to an event where pressure due to accumulation of hot exhaust gases inside the suppressor causes the suppressor to rupture. Furthermore, excessive heating of an outer housing of the suppressor may lead to a "mirage" effect that obscures the operator's vision.

The inventors herein have recognized that excess heat build-up in the suppressor may also result in an "afterburner" effect where unburned propellant may be immediately flashed when exposed to inner surfaces of the suppressor or secondary combustion of burned propellant may occur upon firing. The likelihood of such events is increased when a propellant load configured to burn in a longer firearm barrel is used in short barrel applications. Flashing of unburned propellant or secondary burning may both drive a continual increase in temperature of the suppressor with each firing. In addition, the nitrocellulose component of the propellant may detonate or experience rapid deflagration upon exposure to the fluctuating and excessive temperatures of the suppressor surfaces.

Furthermore, the suppressor may suffer undesirable pressure accumulation even when subjected to low to moderate temperatures. For example, debris may adhere to inner surfaces and accumulate in the suppressor bore, interfering with a trajectory of the projectile and restricting flow of propellant gases. As another example, ice formation during use of the suppressor in cold ambient temperatures, may similarly block the suppressor bore. Such events may result in sudden increases in pressure, e.g., greater than 20 ksi, contained within the suppressor and exert high outward forces on the suppressor outer housing. A suppressor with an outer housing that has become weakened due to extreme heating may have a diminished ability to hold pressure, resulting in an explosive rupturing of the outer housing even at a pressure that is within a designated pressure range that the suppressor is configured to withstand.

In one embodiment, the issues described above may be addressed by a firearms suppressor comprising an outer housing adapted with a blowout panel. The blowout panel may be an area of the outer housing configured to burst open in a manner where ejected debris and gases may be released when the suppressor reaches a threshold pressure and directed away from an operator or towards a desired direction. The blowout panel may reduce the likelihood of degradation to other areas of the suppressor or explosive release of pressure through rupturing of the outer housing of the suppressor during over pressure events.

By providing the suppressor with a blowout panel, pressure generated by propellant gases during firearm discharge may be vented through bursting of the blowout panel. Discharge of the firearm may proceed even after rupturing of the blowout panel albeit with reduced efficiency of noise, flash, and concussion suppression. A likelihood of explosive degradation of the suppressor or rupturing of the suppressor in an undesirable direction is thereby decreased when pressure builds within the suppressor. During occasions when prolonged firing is desirable, firearm discharge is not impeded by malfunctioning of the suppressor or degradation of the suppressor outer housing.

In this way, the firearms suppressor may be operable on any type of auto-loading firearms, including but not limited to machine gun applications, without adversely affecting mechanical operations according to the original firearms design. Further, the firearms suppressor may be operable without adversely impacting use of the suppressor. The utility of the suppressor may therefore be extended and more fully realized. Furthermore, the firearms suppressor may include inner components arranged in a configuration to reduce heat transfer from the inner components to the outer housing, thereby inhibiting the "mirage" effect. In addition, the suppressor may be replaced by 3D-printed, low-cost units produced at lower cost due to efficient scalable manufacturing. Other elements of the disclosed embodiments of the present subject matter are provided in detail herein.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-6 are shown approximately to scale although other relative dimensions may be used, if desired. The drawings may depict components directly touching one another and in direct contact with one another and/or adjacent to one another, although such positional relationships may be modified, if desired. Further, the drawings may show components spaced away from one another without intervening components there between, although such relationships again, could be modified, if desired.

DETAILED DESCRIPTION

The following description relates to systems and methods for adapting a firearms suppressor (also, suppressor) with one or more blowout panels to vent exhaust gases during over pressure events. An example multi-baffled sound suppressor is described herein. The following description relates to various embodiments of the sound suppressor as well as methods of manufacturing and using the device. Potential advantages of one or more of the example approaches described herein relate to reducing a likelihood of uncontrolled and undesirable rupturing of the suppressor leading to degradation of the suppressor and terminating the use of the suppressor. This may occur, for example, when the suppressor is subjected to excessively high pressures related to blockages within the suppressor bore through which exhaust gases and debris may be accelerated. In another example, surfaces of the suppressor may degrade over time due to repeated exposure to high temperatures associated with firearms discharge, resulting in loss of structural integrity upon experiencing relatively high pressures.

By adapting walls of the suppressor with blowout panels, in particular within an outer shell of the suppressor, the blowout panels may be configured to burst when pressure in the suppressor approaches a threshold. Bursting of the blowout panels allows accumulated pressure to dissipate in a desired direction without affecting the continued usage of the suppressor. Aspects of the suppressor and blowout panels, including function and positioning, are explained herein.

Figure 1:
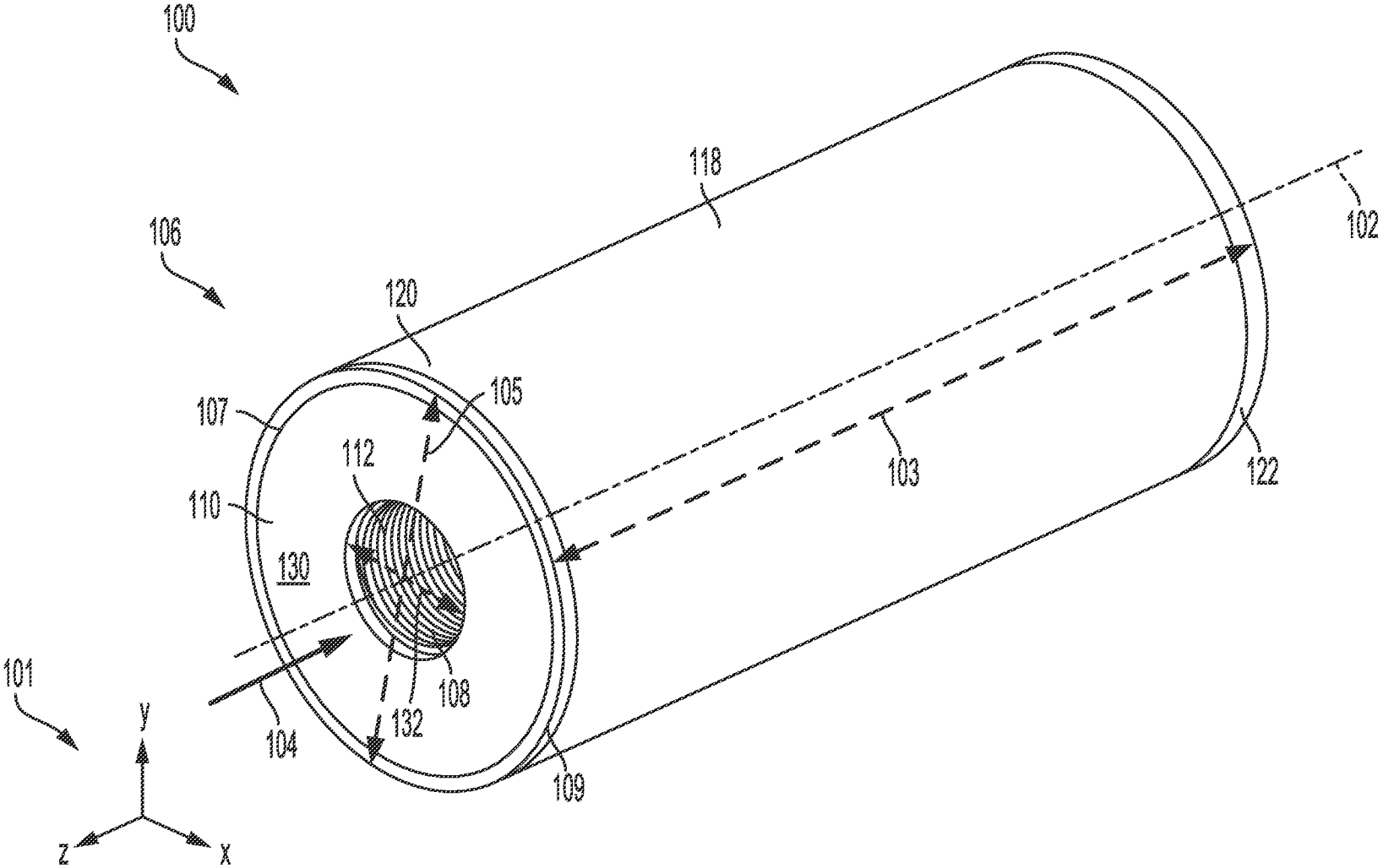
FIG. 1 shows a first embodiment of a firearms suppressor.
Figure 2:
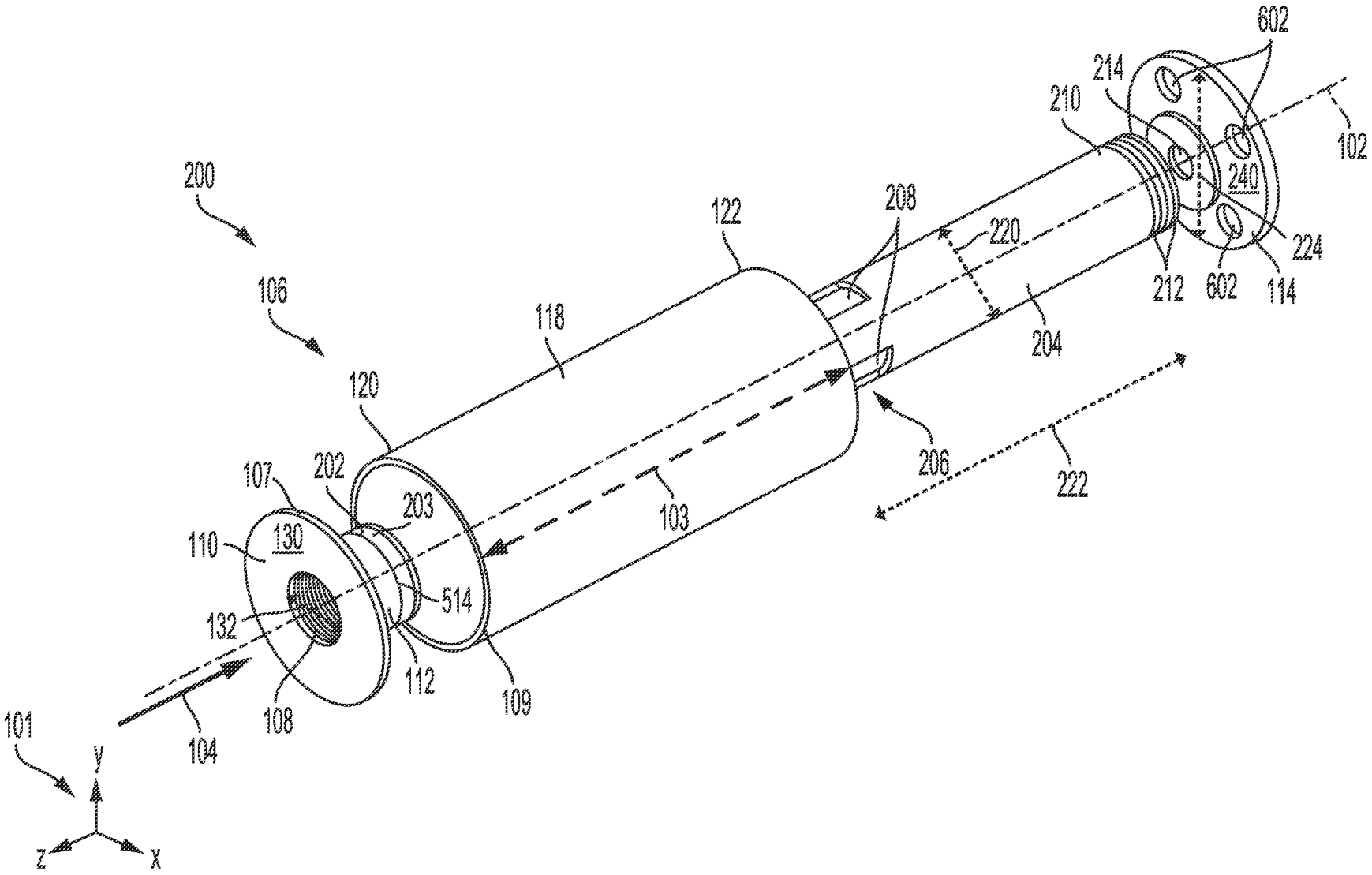
FIG. 2 shows an exploded view of the firearms suppressor.
Figure 3:
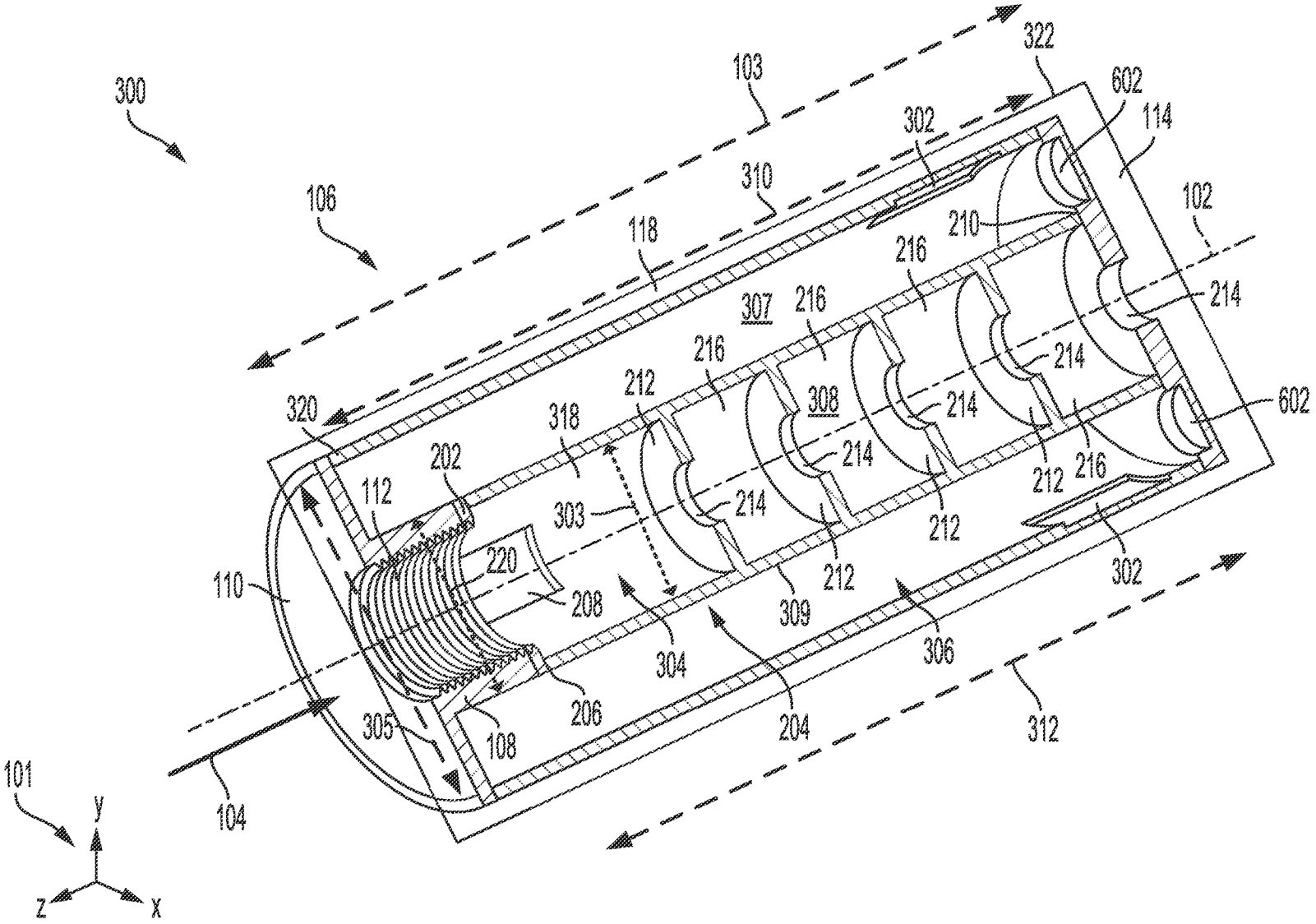
FIG. 3 shows a cross-section of the firearms suppressor.
Figure 4:
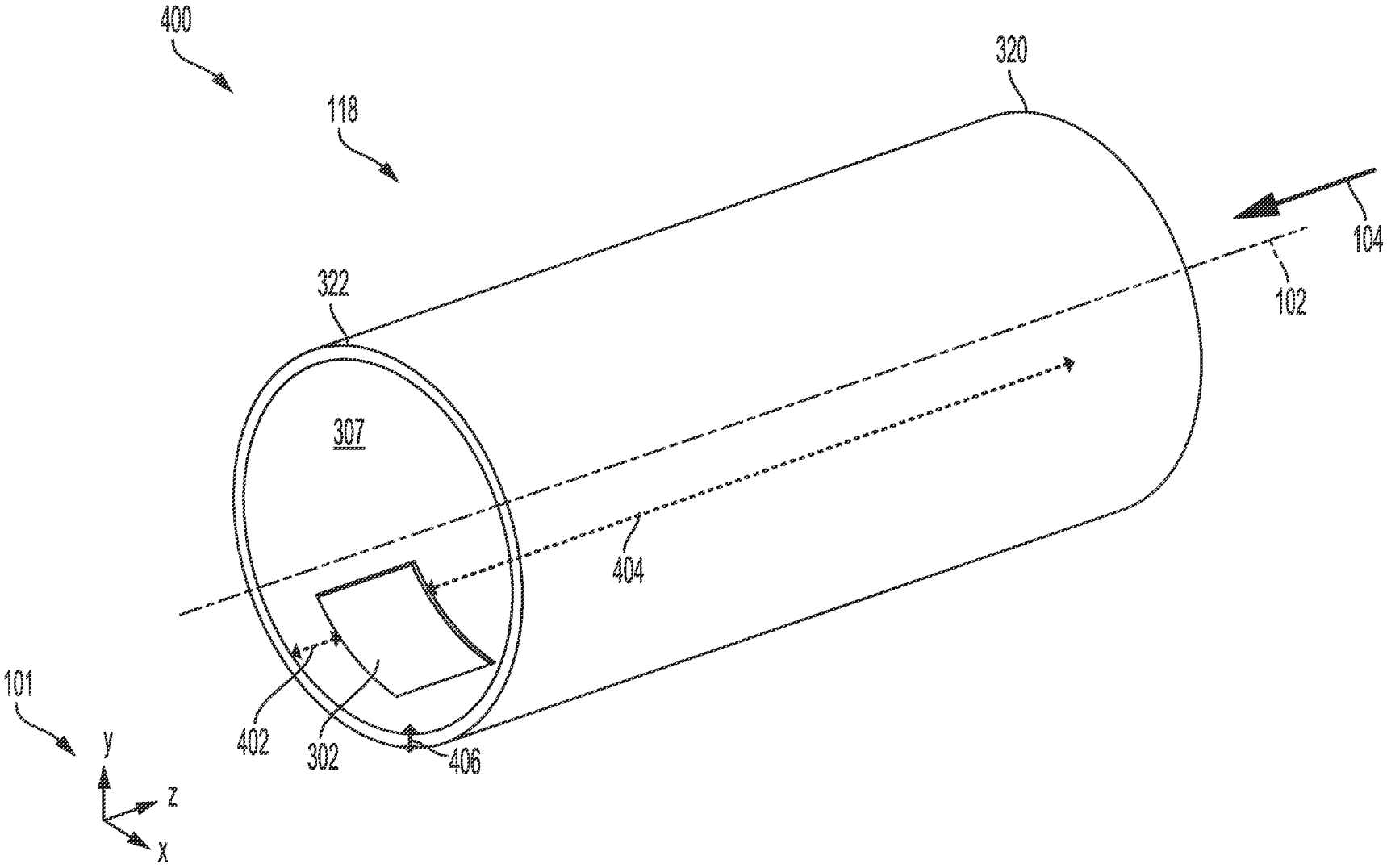
FIG. 4 shows an outer housing of the firearms suppressor adapted with a first set of blowout panels.
Figure 5:
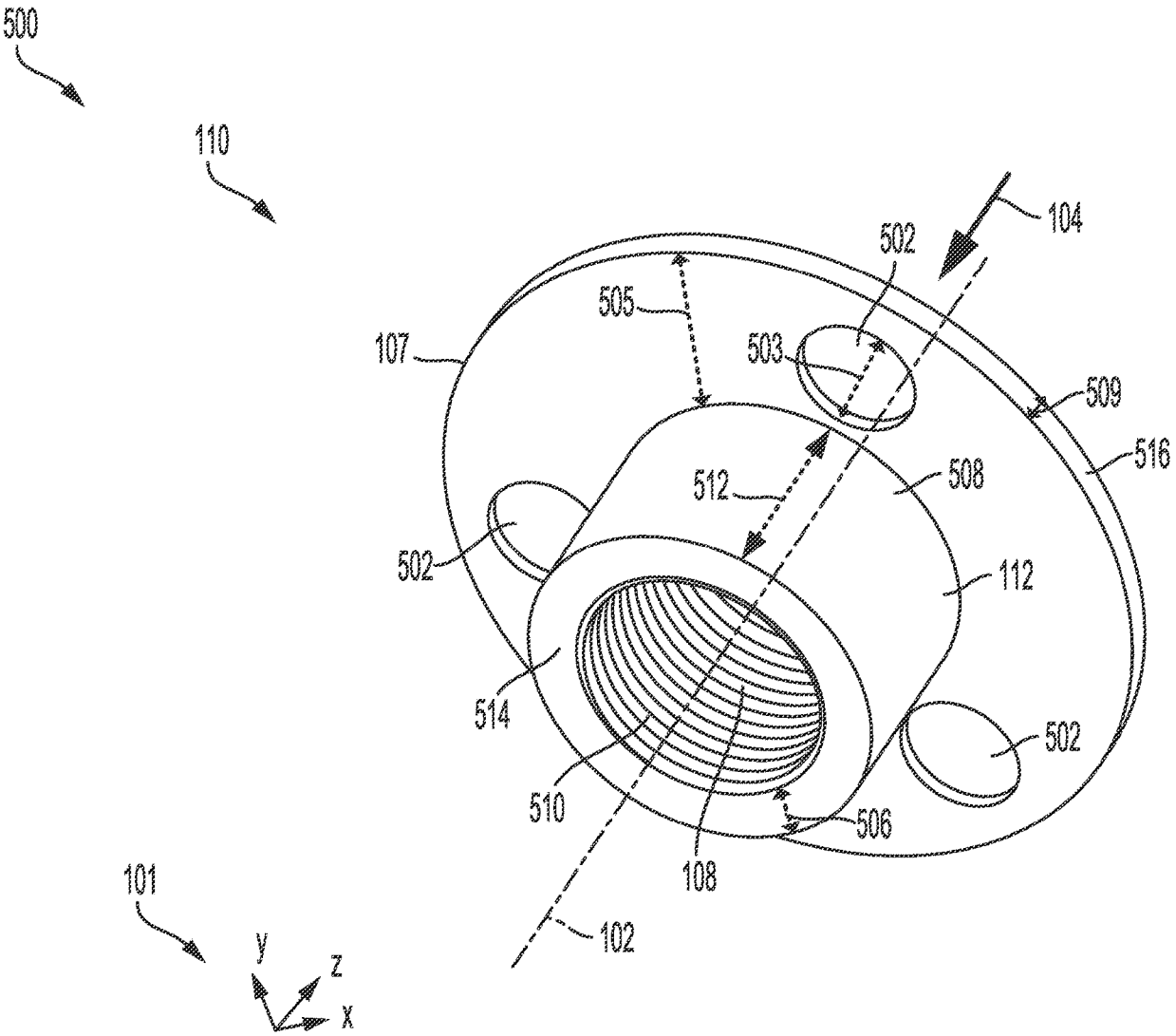
FIG. 5 shows an ingress cap of the firearms suppressor adapted with a second set of blowout panels.
Figure 6:
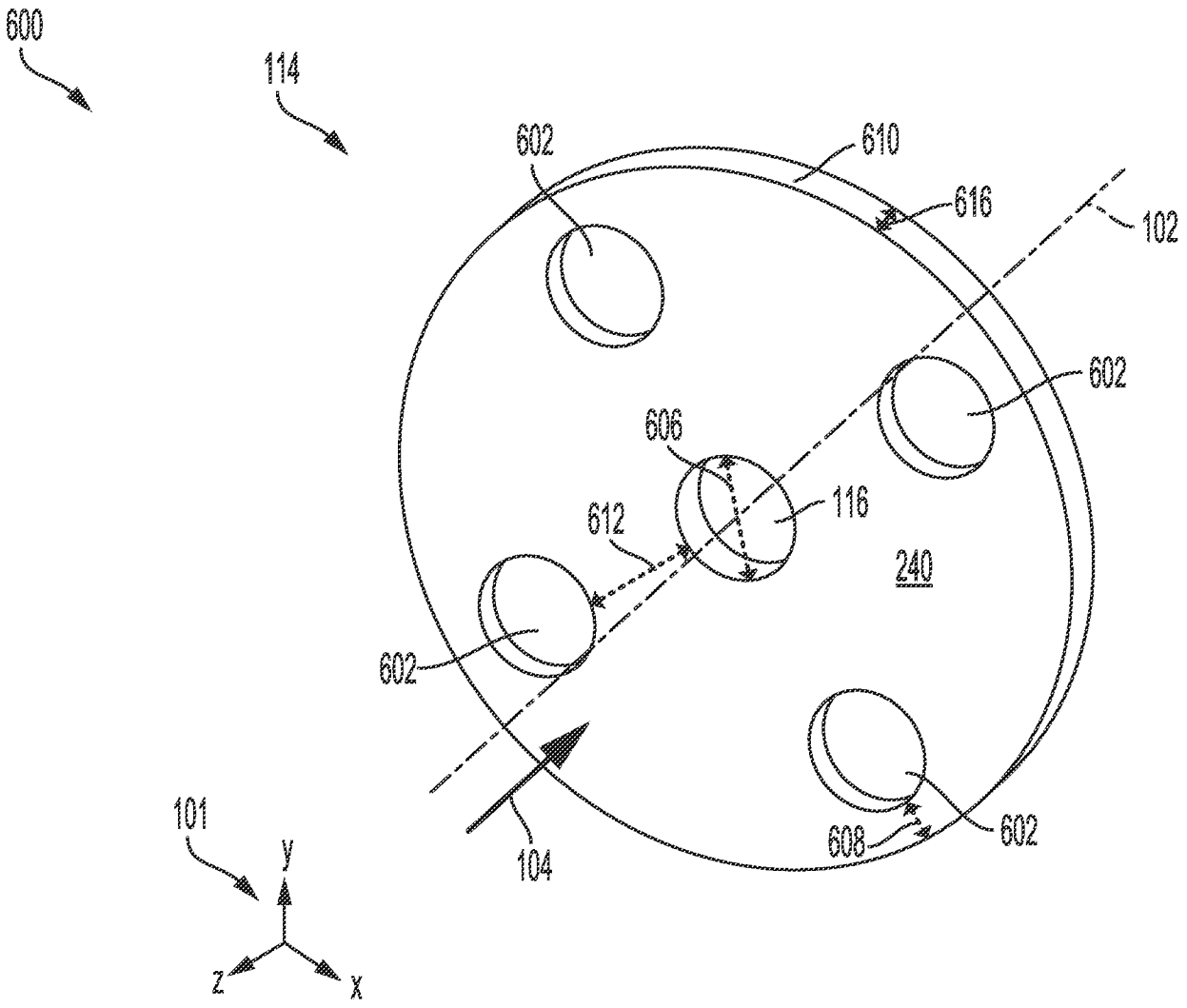
FIG. 6 shows an egress cap of the firearms suppressor adapted with a third set of blowout panels.

An exemplary suppressor in shown in FIG. 1 from an isometric perspective, comprising a rigid outer housing that surrounds a projectile pathway, or suppressor bore, traversing a length of the suppressor. An exploded view of the suppressor is illustrated in FIG. 2, revealing inner components of the suppressor including baffles and an inner sleeve arranged along the length of the suppressor. A length-wise cross-section of the suppressor is shown in FIG. 3, depicting a relative positioning of the inner components of the suppressor. A first set of one or more blowout panels, adapted to alleviate excess pressure accumulation in the suppressor, may be disposed in an outer housing of the suppressor, as shown in FIG. 4. Additionally or alternatively, blowout panels of different shapes, as illustrated in FIGS. 5 and 6, may be positioned at an ingress cap and an egress cap of the suppressor.

Further, FIGS. 1-6 show the relative positioning of various components of the suppressor assembly. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being triangular, helical, straight, planar, curved, rounded, spiral, angled, or the like). Further, elements shown intersecting one another may be referred to as intersecting elements or intersecting one another, in at least one example. Further still, an element shown within another element or shown outside of another element may be referred as such, in one example. For purposes of discussion, FIGS. 1-6 will be described collectively. Elements that are common between figures will be similarly numbered and will not be re-introduced.

Turning now to FIG. 1, a first embodiment 100 of a suppressor 106 for firearms is shown. Suppressor 106 may be a cylinder with an outer housing 118 that forms a smooth outer surface of suppressor 106, the outer housing 118 formed from a rigid, durable material with high heat tolerance. A set of reference axes 101 is provided for comparison of views shown, indicating a y-axis, an x-axis, and a z-axis. In some examples, the y-axis may be parallel with a vertical direction, the x-axis parallel with a horizontal direction, and the z-axis parallel with a transverse direction. Suppressor 106 has a central axis 102 and a direction of projectile travel through a length 103 of suppressor 106, the length being coaxial with the central axis 102, is indicated by arrow 104. The length 103 of suppressor 106 is greater than a diameter 105 of suppressor 106 and a cross-section of suppressor 106, taken along the x-y plane, may be circular while a cross-section taken along the z-y plane (as shown in FIG. 3) may be rectangular. Components of suppressor 106 will be described approximately in order along the projectile path. As such, the positioning of elements will be defined with respect to the projectile path of suppressor 106. Thus, an element in the projectile path of a reference point may be referred to as being downstream of the reference point while an element before a reference point in the projectile path may be referred to as being upstream of the said reference point.

A projectile, such as a bullet, may enter suppressor 106 at an inlet 108 of an ingress cap 110. The inlet 108 may be an entry point of an inner bore of suppressor 106, the bore defining the path of projectile travel and extending across the length 103 of suppressor 106, along the central axis 102. The ingress cap 110 may be an upstream wall of suppressor 106, defining an extreme upstream end of suppressor 106 and assisting in sealing the inner components of suppressor 106 within ingress cap 110 and other outer surfaces. For example, an outer perimeter 107 of the ingress cap 110 may be circular with a diameter matching the diameter 105 of suppressor 106, allowing the ingress cap 110 to be sealingly coupled to the suppressor 106 at an upstream edge 109 of suppressor 106. The inlet 108 may be a circular aperture centered about a geometric center of the ingress cap 110, the geometric center aligned with the central axis 102. The ingress cap is a relatively thin disk, as shown in FIG. 5, with a thickness 509 defined along the z-axis and with an annular cross-section, taken along a plane perpendicular to the central axis 102. An upstream surface 130 of the ingress cap 110 is planar and arranged perpendicular to the central axis 102 so that the inlet 108 is centered about the central axis 102.

The inlet 108 may be surrounded by a projection 112 that is coupled to a downstream surface (e.g. a downstream surface 504 shown in FIG. 5) of the ingress cap 110 and extends in a downstream direction away from ingress cap 110. The projection 112 is depicted in greater detail in FIG. 5 and discussed further below. Note that the direction of projectile travel is reversed in FIG. 5 relative to FIG. 1, as indicated by arrow 104. Returning to FIG. 1, the projection 112 is a hollow cylinder with an annular cross-section when taken along the x-y plane. A thickness (e.g., a thickness 506 shown in FIG. 5), of the projection 112, taken in a radial direction relative to the central axis 102 may be similar to or greater than the thickness of the ingress cap 110. An inner diameter 132 of the projection 112 may be similar to a diameter of the inlet 108. The projection 112 may have a smooth outer surface and a threaded inner surface (e.g., outer surface 508 and inner surface 510 shown in FIG. 5). The threading of the inner surface 510 may mate to threading on a barrel end of a firearm, providing a mechanism for coupling suppressor 106 to the firearm. The projection 112 may extend a distance (e.g., distance 512 shown in FIG. 5) into an interior of suppressor 106 with a free downstream end (e.g., a downstream end 514 of the projection 112 shown in FIGS. 2 and 5) that is not coupled to another component. Although not coupled, the downstream end 514 of the projection 112 may be in contact with an optional first baffle.

A first baffle 202 is shown in an exploded view 200 of suppressor 106 in FIG. 2, immediately downstream of the downstream end 514 of the projection 112, arranged in face-sharing contact with a downstream surface of the end of the projection 112. In other words, a surface of the downstream end 514 of the projection 112, the surface co-planar with the x-y plane, is in direct contact with an upstream surface 203 of the first baffle 202. The first baffle 202 may be a thin disc, a thickness of the first baffle 202 defined along the z-axis, with a central aperture that is aligned with the central axis 102, encircling both the suppressor bore and the inlet 108 but has a smaller diameter than the inlet 108 (e.g., smaller than the inner diameter 132 of the projection 112). By having a narrower central aperture than both the inlet 108 and inner diameter of the projection 112, the first baffle 202 may act as a barrier to further insertion of a firearm barrel end. For example, the barrel end, upon insertion into the projection 112 by rotating suppressor 106 so that the threading along the inner surface of the projection 112 engages with threading on the barrel end, may come into contact with the first baffle 202, halting any further rotation of suppressor 106 and further extension of the barrel end into the projection 112 of the ingress cap 110. It will be appreciated that while the first baffle is shown in FIG. 2, other examples of suppressor 106 may not include the first baffle 202.

The first baffle 202 may be held in place by contact with the projection 112 at the upstream surface 203 and contact with a first end 206 of an inner sleeve 204, as shown in FIG. 2, at a downstream surface of the first baffle 202, the downstream surface opposite of the upstream surface 203. In other words, the first baffle 202 may be sandwiched between the projection 112 and the inner sleeve 204. The inner sleeve 204 may be an elongate hollow cylinder with a relatively thin shell, a thickness of the inner sleeve 204 define along the radial direction relative to the central axis 102, aligned longitudinally with the central axis 102, and positioned between the ingress cap 110 and an egress cap 114, as shown in FIGS. 2 and 3. The inner sleeve 204 may have an outer diameter 220 that is equal to an outer diameter of the first baffle 202 and an outer diameter of the projection 112 of the ingress cap 110. The first end 206 of the inner sleeve 204 may comprise a set of cut-outs 208 that are rectangular in shape and constitute portions of the inner sleeve 204 that have been removed at the first end 206, forming openings at the first end 206 of the inner sleeve 204.

The first end 206 of the inner sleeve 204 is an upstream end of the inner sleeve 204 and thus the set of cut-outs 208 are positioned proximate to the upstream edge 109 of suppressor 106, immediately downstream of the projection 112 of the ingress cap 110, when the inner sleeve 204 is inserted into the outer housing 118 of the suppressor 106. The set of cut-outs 208 may extend downstream from the first end 206 of the inner sleeve 204.

A length 222 of the inner sleeve 204, defined along the central axis 102, may be shorter than the length 103 of suppressor 106, allowing the inner sleeve 204 to fit between the downstream end of the projection 112 of the ingress cap 110 and the egress cap 114. When sandwiched between the ingress cap 110 and egress cap 114, a second end 210 of the inner sleeve 204 may seal against the egress cap 114 but the set of cut-outs 208 provide openings at the first end 206 proximate to the inlet 108 of suppressor 106, the set of cut-outs 208 spaced away from the ingress cap 110 by the projection 112 of the ingress cap 110. The set of cut-outs 208 fluidly couples an inner chamber 304 of the inner sleeve 204 to an outer chamber 306 formed between an outer surface of the inner sleeve 204 and an inner surface of the outer housing 118 of the suppressor 106, the inner chamber 304 and the outer chamber 306 shown in FIG. 3. The outer chamber 306 may extend along the entire length 103 of suppressor 106. During firearm discharge, exhaust gases and debris accelerating into the suppressor 106 through the inlet 108 may be diverted through the set of cut-outs 208 radially outwards and away from the central axis 102 as a projectile traverses the central axis 102 along the bore of suppressor 106. This may reduce an accumulation of debris within the suppressor bore by directing the debris away from the projectile path before the debris travels downstream beyond the first end 206 of the inner sleeve 204.

A downstream surface, the downstream surface co-planar with the x-y plane, of the second end 210 of the inner sleeve 204 may be in face-sharing contact with an upstream surface 240 of the egress cap 114. The egress cap 114 is shown in FIGS. 2, 3, and depicted in greater detail in FIG. 6. Arranged at a downstream end of suppressor 106, and opposite of the ingress cap 110, the egress cap 114 may define a most downstream wall of suppressor 106. The egress cap 114 is a relatively thin disk with an annular cross-section, taken along a plane perpendicular to the central axis 102, with planar upstream and downstream surfaces that are perpendicular to the central axis and a central aperture 604, as shown in FIG. 6, that is centered about the central axis 102. A diameter 224 of the egress cap 114, as shown in FIG. 2, may be similar to the diameter 105 of the ingress cap 110, as shown in FIG. 1 (and to the diameter of the outer housing 18 of suppressor 106). The central aperture 604 of the egress cap 114 may also be an outlet of suppressor 106. Similar to the ingress cap 110, the egress cap 114 may assist in sealing inner components of suppressor 106 between the ingress cap 110, the egress cap 114 and the outer housing 118.

The central aperture 604, as shown in FIG. 6, of the egress cap 114 may be narrower in diameter 606 than the diameter 132 of the inlet 108 (also the inner diameter of the projection 112 of the ingress cap 110) and similar to the diameter of the central aperture of the first baffle 202. The diameter 606 of the central aperture 604 of the egress cap 114 may be similar to and aligned along the central axis 102 with central apertures 214 of baffles 212, arranged within the inner chamber 304 (as shown in FIG. 3) of the inner sleeve 204. Thus the projectile path, or suppressor bore, is encircled by the projection 112 of the ingress cap 110, the central aperture of the first baffle 202, the central apertures 214 of the baffles 212, and the central aperture 604 of the egress cap 114. By adapting the central aperture 604 of the egress cap 114 to be narrower than the diameter 132 of the inlet 108 of suppressor 106, particulate matter released during firearm discharge that is propelled through the suppressor bore may be less likely to exit suppressor 106. The narrower central aperture 604 of the egress cap 114 may increase a portion of the particulate matter that is not aligned with the central aperture 604, instead striking the upstream surface 240 of the egress cap 114 and remaining trapped within suppressor 106.

Turning now to FIG. 3, a length-wise cross-section 300 of suppressor 106 is shown, the cross-section 300 taken along the z-y plane. The cross-section 300 shows a positioning of the first baffle 202 in face-sharing contact with the downstream end, e.g., the downstream end 514 shown in FIG. 5. A first chamber 318, disposed downstream of the first baffle 202 and upstream of the baffles 212 is included within the inner chamber 304 of the inner sleeve 204. The inner chamber 304 extends from the first baffle 202, along the central axis 102, to the egress cap 114 and includes the baffles 212 arranged aligned along the central axis 102, each baffle of the baffles 212 spaced evenly apart from adjacent baffles 212.

The baffles 212 are similar in geometry to the first baffle 202, configured as thin disks with planar upstream and downstream surfaces that are arranged perpendicular to the central axis 102. Outer diameters 303 of the baffles 212 may be narrower than the outer diameter of the first baffle 202 and similar to an inner diameter of the inner sleeve 204 so that the baffles fit inside the inner sleeve 204. In other words, the outer diameters 303 of the baffles 212 may be the same as an inner diameter of the inner sleeve 204. Outer edges of the baffles 212 are in contact with an inner surface 308 of the inner sleeve 204 and the baffles 212 are spaced apart from one another, forming baffle chambers 216 between each of the baffles 212.

The inner components of suppressor 106, including the first baffle 202, the inner sleeve 204, and the baffles 212, may be formed from a material that readily absorbs heat, such as steel, stainless steel, aluminum, ceramic, or a composite. Heat from high pressure exhaust gases propelling the projectile along the projectile path is primarily absorbed by the baffles 212 but also by the inner sleeve 204. The combination of the inner sleeve 204 adapted with the set of cut-outs 208 at the upstream end and baffles 212 allows pressure generated during firearm discharge to be dissipated by channeling exhaust gases and debris out of the first chamber 318 through the set of cut-outs 208 from the inner chamber 304 of the inner sleeve 204 to the outer chamber between the outer surface of the inner sleeve 204 and the inner surface of the outer housing 118. Exhaust gas energy is also reduced via heat exchange with the baffles 212. For containment of the pressure and exhaust gases formed during firing, the inner components of suppressor 106 may be surrounded by the outer housing 118.

The outer housing 118 may be a hollow cylindrical shell, aligned longitudinally with and centered about the central axis 102. An inner diameter 305 of the outer housing 118 is sufficiently wide to accommodate insertion of the inner sleeve 204 so that the outer housing 118 circumferentially surrounds the inner sleeve 204 while allowing an outer surface 309 of the inner sleeve 204 to be spaced away from an inner surface 307 of the outer housing 118. A space between the outer surface 309 of the inner sleeve 204 and the inner surface 307 of the outer housing 118 forms the outer chamber 306. The length of the outer housing 118 is the length 103 of suppressor 106.

The inner diameter 305 of the outer housing 118 may be the same as the outer diameters of the ingress cap 110 and the egress cap 114, e.g., the diameter 224 of the egress cap 144 shown in FIG. 2. In this way, the ingress cap 110 and the egress cap 114 may fit within the outer housing 118 so that outer edges of the ingress cap 110 (e.g., the outer edge 516 of FIG. 5) and the egress cap 114 (e.g., the outer edge 610 of FIG. 6) contact the inner surface 307 of the outer housing 118. A first, upstream end 320 of the outer housing 118 is coupled to the ingress cap 110 and a second, downstream end 322 is coupled to the egress cap 114. In one example, the ingress cap 110 and egress cap 114 may be attached to the outer housing 118 by adapting the ingress cap 110 and egress cap 114 with threading that mates to threading disposed on the inner surface 307 of the outer housing 118 at the first and second ends 320, 322. In another example, the ingress cap 110 and egress cap 114 may be welded to the first and second ends 320, 322 of the outer housing 118. Alternatively, suppressor 106 may be printed by a 3-D printer as a unitary, continuous structure.

The outer chamber 306 circumferentially surrounds the inner chamber 304, forming a space around the inner sleeve 204, between the inner sleeve 204 and the outer housing 118 of suppressor 106. A cross-section of the outer chamber 306 taken along the x-y plane may be annular and centered about the central axis 102. The outer chamber 306 may have a longer length 310 than a length 312 of the inner chamber 304. The outer chamber 306 may provide a buffer zone that decreases heat transfer from the baffles 212 and the inner sleeve 204 to the outer housing 118, thereby reducing a mirage effect resulting from heating of the outer housing 118 and decreasing emission of particulate matter from the outlet of suppressor 106, e.g., the central aperture 604 of the egress cap 114 as shown in FIG. 6. Furthermore, the inner components of suppressor 106 aid in reducing a velocity of exhaust gases travelling through suppressor 106, thereby dampening noise associated with firearm discharge.

For example, upon firing, the projectile may travel in the direction indicated by arrow 104 into the inlet 108 of suppressor 106. The projectile accelerates through the projection 112 of the ingress cap 110 and enters the first chamber of the inner sleeve 204. High pressure exhaust gases accompany the projectile and, upon reaching the first chamber, at least a portion of the gases may be diverted through the set of cut-outs 208 in a radially outwards direction, away from the central axis 102. A velocity of the diverted gases may be retarded due to a non-linear flow of the diverted gases, relative to a portion of the gases that are not diverted and continue travelling through the inner sleeve 204. As a result, high intensity sound waves emanating from suppressor 106 are suppressed.

A remaining portion of the exhaust gases may be entrained along the central axis 102 as the projectile proceeds to pass through each central aperture of the central apertures 214 of the baffles 212 along the length 312 of the inner chamber 304 until the projectile reaches the central aperture of the egress cap 114 and exits suppressor 106 along a linear trajectory. The exhaust gases flowing through the inner sleeve 204 may encounter surfaces of one or more of the baffles 212, with less and less of the gases flowing the central apertures 214 of each progressively more downstream baffle. When the gases strike the surfaces of the baffles 212, the gases are deflected from a flow path through the inner sleeve 204, creating turbulence and decreasing the velocity of the gases as well as any particulate matter generated during projectile discharge.

The exhaust gases may be hot, heating the surfaces of the inner sleeve 204 and baffles 212. Convectional transfer of heat from the inner sleeve 204 to the outer housing 118 is reduced by positioning the outer chamber 306 around the inner sleeve 204. Thus, deceleration of exhaust gases through suppressor 106 dampens sounds and positioning of the outer chamber 306 around the inner sleeve 204 provides an insulating layer of air that reduces heating of the outer housing 118 of suppressor 106.

It will be appreciated that suppressor 106 is a nonlimiting example of a firearms suppressor and while the baffles 212 are depicted as circular disks, other examples of the baffles may include square, triangular, hexagonal, and other geometries. Similarly, the set of cut-outs 208 of the inner sleeve 204 may have alternate shapes other than rectangles and the number of cut-outs in the set of cut-outs 208, the number of the baffles 212, the spacing of the baffles 212, and the geometry of the inner sleeve 204 may be varied without departing from the scope of the present disclosure. Furthermore, other examples of suppressor 106 may deviate from a cylindrical outer geometry, instead having a cross-section that may be square, triangular, oval, etc.

Outer components of suppressor 106, including outer housing 118, the ingress cap 110, and the egress cap 114, may be formed from similar materials as the inner components of suppressor 106, such as stainless steel, ceramic, a composite, etc. but rated to a higher tolerance of heat and pressure. Although the outer components may be configured to withstand exhaust gas pressures of up to 20 ksi, repeated exposure to high temperatures, in spite of heat absorption by the baffles 212 and spacing away of the inner sleeve 204 to minimize heat transfer, may degrade the tensile strength of the outer components over time. Degradation of the outer components may result in random and undesirable rupturing of the outer components. In addition, pressure may accumulate beyond tolerance levels if the projectile pathway is impeded by debris or, in cold ambient conditions, ice formation, similarly resulting in uncontrolled eruption of suppressor 106.

To reduce the likelihood of explosive malfunction, the outer components may be configured with blowout panels. An example of the outer housing 118 adapted with a set of first set of blowout panels 302 is shown in FIG. 3 and depicted in greater detail in a perspective view 400 of the outer housing 118 of suppressor 106 in FIG. 4. Note that the alignment of the outer housing 118 along the central axis 102 is reversed in FIG. 4 with respect to FIG. 3. The first set of blowout panels 302 may be rectangular recesses in the inner surface 307 of the outer housing 118, proximal to the second end 322 of the outer housing 118 but spaced away from the second end 322. A distance 402 by which the first set of blowout panels 302 are spaced away from the second end 322 of the outer housing 118 is shorter than a distance 404 by which the first set of blowout panels 302 are spaced away from the first end 320.

The first set of blowout panels 302 may be evenly spaced apart around a circumference of the inner surface of the outer housing 118. For example, two panels of the first set of blowout panels 302 are shown in FIG. 3, arranged at opposite sides of the outer housing 118. Each blowout panel of the first set of blowout panels 302 may extend into a portion of a thickness 406 of the outer housing 118 by an amount between 10-90% of the thickness 406, depending on the material from which the first set of blowout panels 302 are formed and explained further below. Additionally or alternatively, a second set of blowout panels 502 may be arranged in the ingress cap 110 as shown in a perspective view 500 of the ingress cap 110 in FIG. 5.

The second set of blowout panels 502 may be circular recesses in the inner, downstream surface 504 of the ingress cap 110. A diameter 503 of each of the second set of blowout panels 502 may be smaller than a distance 505 between the projection 112 and an outer edge 516 of the ingress cap 110. The second set of blowout panels 502 may be evenly spaced apart from one another around a circumference of the ingress cap 110, arranged around and spaced away from the projection 112 of the ingress cap 110 and also spaced away from the outer edge 516 of the ingress cap 110. Similar to the first set of blowout panels 302, the second set of blowout panels 502 may extend into a portion of the thickness 509 of the ingress cap 110 by an amount such as 10-90% of the thickness 509.

A third set of blowout panels 602, shown in FIGS. 2, 3, and 6, may be similarly shaped as the second set of blowout panels 502, also configured as circular recesses in an inner, upstream surface of the egress cap 114. The third set of blowout panels 602 are shown in greater detail in a perspective view 600 of the egress cap 114 in FIG. 6. The third set of blowout panels 602 may be evenly spaced apart from one another, arranged around the central aperture 604. Each panel of the third set of blowout panels 602 may be spaced a first distance 608 way from an outer edge 610 of the egress cap 114 and spaced a second distance 612 away from the central aperture 604. The second distance 612 may be greater than the first distance 608.

The egress cap 114 may have a thickness 616, defined along the central axis 102. The third set of blowout panels 602 may extend into at least a portion of the thickness 616 of the egress cap 114, from the upstream surface 240 in the downstream direction. The extension of the third set of blowout panels 602 may be from 0-90% of the thickness 616 of the egress cap 114.

It will be appreciated that in the examples depicted in FIGS. 1-6, while showing the first set of blowout panels 302 as two rectangular panels, the second set of blowout panels 502 as three circular panels, and the third set of blowout panels 602 as four circular panels, are nonlimiting examples of blowout panels arranged in the outer housing 118, ingress cap 110, and egress cap 114. Other examples may include variations in the shapes of the each set of blowout panels, the number of panels in each set of blowout panels, the sizes of the panels, and orientation of the panels relative to the surface in which the blowout panels may be disposed. For example, the first set of blowout panels 302 may be arranged at a midpoint between the upstream end and the downstream end of the suppressor 106 instead of the downstream end, or comprise one, three, or four panels, or be circular in shape. Furthermore, the suppressor 106 may have any combination of the first, second, and third set of blowout panels 302, 502, 602. In one example, the suppressor 106 may include the first set of blowout panels 302 and the third set of blowout panels 602. In another example, the suppressor 106 may be configured with the second and third sets of blowout panels 502, 602, but not the first set of blowout panels 302. It will be appreciated that the suppressor may be adapted with different configurations and combinations of the blowout panels without departing from the scope of the present disclosure.

As described above, the first, second, and third sets of blowout panels 302, 502, 602 (collectively, the blowout panels herein), may be simply regions where the material from which the outer components of suppressor 106, such as the outer housing 118, the ingress cap 110 and the egress cap 114, are formed is thinner, thus lowering a resistance of the panels to outward (e.g., radially away from the central axis 102) deformation and rupture. In other words, the blowout panels may have lower tensile strengths than the material surrounding the blowout panels. For example, when pressures inside the suppressor approach a threshold, such as 10 ksi for a full length barrel or 20 ksi for a short barrel firearm, the thinner blowout panels rupture and release the accumulated pressure. The likelihood of other areas of the suppressor rupturing upon exposure to high pressure is thus reduced and an operator may continue firing the firearm coupled to the suppressor without adversely affect firing capability. However, an effectiveness of the suppressor, with respect to suppression of noise, flash, and concussion, may be reduced.

Variations in implementation of the blowout panels are possible. As an alternative to forming thinner panels in the surfaces of the outer housing and/or the ingress and egress caps, the blowout panels may be formed from a lower density material during a printing process on a 3-D printer with a same thickness as the surface in which it is disposed. For example, the first set of blowout panels 302, as shown in FIG. 4, may be of an equal thickness as the thickness 406 of the outer housing 118. The first set of blowout panels 302 may be securely coupled to and framed by the material of the outer housing 118, such as metal or a composite, but formed from a different material, such as a plastic or a low density composite. The lower density material of the blowout panels has a lower tensile strength than the higher density material of the outer components of the suppressor and thus may be more prone to breaching during increases in pressure. As another example, the blowout panels may be holes extending entirely through the surfaces of the outer housing and/or front and egress caps. Plugs with a diameter similar to the holes, may be installed in the holes either by pressing the plugs or by adapting the surfaces of the plugs and the edges of the holes with threading configured to couple with one another when the plugs are rotated in contact with the edges of the holes. The plugs may be pressed or threaded into the holes from an outside or inside (e.g., exterior or interior) of the suppressor. If installed from the inside, mechanical lips may be disposed in the holes to retain a position of the plugs until an inner pressure of the suppressor rises above the threshold level.

Furthermore, to control a direction of release of exhaust gases and particulate material such as debris, primer, powder residue, lead shavings, etc., the suppressor may be adapted with containment structures coupled to an exterior surface of the suppressor surrounding each of the blowout panels. For example, small cages may be attached or printed into the suppressor to trap particulate matter escaping through the blowout panels. As another example, shrouds may be configured to externally surround the blowout panels to channel exhaust gases and particulate material towards a desired direction. Equipment or persons within a certain vicinity of the firearm may be thus be shielded from forcible contact from particulate matter and exhaust gases released from the blowout panels when the blowout panels burst.

In this way, a firearms suppressor may be used to dampen noises produced during projectile discharge. The suppressor bore may extend through central apertures of a plurality of baffles, the plurality of baffles spaced apart from one another and aligned along a central axis of the suppressor. The baffles may be enclosed by an inner sleeve of the suppressor, the inner sleeve inserted into an outer housing and spaced away from the outer housing by a chamber surrounding the inner sleeve that decreases heat transfer from the plurality of baffles and inner sleeve to the outer housing. As a result, reduction of a mirage effect, produced by heating of the outer housing and leading to obscuring of an operator's vision, may be achieved. Additionally, outer components of the suppressor, such as the outer housing, an ingress cap and an egress cap, may include blowout panels. The blowout panels may be sections in each of the outer components where a material of the blowout panel is weaker than surrounding material, either by configuring the blowout panels to be thinner than surrounding material or formed from a lower density material than surrounding material. Alternatively, the blowout panels may be apertures adapted with plugs. When an inner pressure of the suppressor rises above a threshold, due to, for example, a blockage in the suppressor bore, the blowout panels may burst (or the plugs may be ejected), alleviating the pressure accumulated within the suppressor and reducing a likelihood of degradation of the suppressor components that may adversely affect the operator and continued operation of the firearms suppressor.

It will be understood that the figures are provided solely for illustrative purposes and the embodiments depicted are not to be viewed in a limiting sense. From the above description, it can be understood that the sound suppressor and/or combination of the sound suppressor and firearm disclosed herein and the methods of making them have several advantages, such as: (1) they reduce the time required to achieve a pressure reduction of the exhaust gases of the firearm thereby avoiding mechanical malfunction of auto-loading firearms; (2) they reduce the mirage effect by minimizing the thermal transfer from the baffle exhaust gas tubes to the outer wall of the suppressor; (3) they improve accuracy and reliability; (4) they aid in the dissipation of heat and reduce the tendency of the suppressor to overheat; (5) they reduce the sound signature of the firearm during operation; and (6) they can be manufactured reliably and predictably with desirable characteristics in an economical manner.

It is further understood that the firearm sound suppressor described and illustrated herein represents only example embodiments. It is appreciated by those skilled in the art that various changes and additions can be made to the firearm sound suppressor without departing from the spirit and scope of this disclosure. For example, the firearm sound suppressor could be constructed from lightweight and durable materials not described.

As used herein, an element or step recited in the singular and then proceeded with the word "a" or "an" should be understood as not excluding the plural of said elements or steps, unless such exclusion is explicitly stated. Furthermore, references to "one embodiment" of the present subject matter are not intended to be interpreted as excluding the existence of additional embodiments that also incorporate the recited features. Moreover, unless explicitly stated to the contrary, embodiments, "comprising," "including," or "having" an element or a plurality of elements having a particular property may include additional such elements not having that property. The terms "including" and "in which" are used as the plain-language equivalents to the respective terms "comprising" and "wherein." Moreover, the terms "first," "second," and "third," etc. Are used merely as labels, and are not intended to impose numerical requirements or a particular positional order on their objects.

This written description uses examples to disclose the invention, including best mode, and also to enable a person of ordinary skill in the relevant art to practice the invention, including making and using any devices or systems and performing any incorporated methods.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

In one representation, a suppressor is provided formed of a unitary material, such as via laser metal sintering or another related process such as 3D printing. The suppressor may include one or more blowout panels configured to dissipate pressure accumulation within the suppressor. For example, to mitigate the issues related to a blockage in the suppressor that hinders release of exhaust gases or degradation of outer containment components of the suppressor, blowout panels may be arranged in an outer housing, an ingress cap and/or egress cap of the suppressor. In one example, the blowout panels may be configured to be less structurally resistant to forces exerted against the blowout panels than a material surrounding the blowout panels. The blowout panels may rupture and dissipate pressure building within the suppressor before the pressure reaches a level that may result in degradation and malfunction of the suppressor.

In one embodiment, a suppressor includes a set of inner components including an inner sleeve and a plurality of baffles and a set of outer components including an outer housing, an ingress cap at a first end of the outer housing, an egress cap at a second end of the outer housing, the second end opposite of the first end, and one or more blowout panels disposed in one or more surfaces of the set of outer components, wherein the set of inner components are entirely enclosed within the set of outer components. In a first example of the suppressor, the blowout panels have a lower pressure tolerance than a material surrounding the blowout panels. A second example of the suppressor optionally includes the first example, and further includes wherein the blowout panels are defined by a structural irregularity in metal forming walls of the outer components of the suppressor. A third example of the suppressor optionally includes one or more of the first and second examples, and further includes, wherein the blowout panels are arranged in an inner surface of the outer housing. A fourth example of the suppressor optionally includes one or more of the first through third examples, and further includes, wherein the blowout panels are arranged in a downstream surface of the ingress cap. A fifth example of the suppressor optionally includes one or more of the first through fourth examples, and further includes, wherein the blowout panels are arranged in an upstream surface of the egress cap. A sixth example of the suppressor optionally includes one or more of the first through fifth examples, and further includes, wherein the blowout panels are defined by at least one frangible narrowing of thickness relative to a material surrounding the blowout panels. A seventh example of the suppressor optionally includes one or more of the first through sixth examples, and further includes, wherein the blowout panels are formed from a lower density material than the outer housing, ingress cap, and egress cap. An eighth example of the suppressor optionally includes one or more of the first through seventh examples, and further includes, a projectile pathway extending from an inlet in the ingress cap to an outlet in the egress cap along a central axis of the suppressor. A ninth example of the suppressor optionally includes one or more of the first through eighth examples, and further includes, wherein the ingress cap includes a projection encircling the inlet and extending from a downstream surface of the ingress cap in a downstream direction and wherein an inner surface of the projection is adapted with threading. A tenth example of the suppressor optionally includes one or more of the first through ninth examples, and further includes, wherein the inner sleeve extends from the projection of the ingress cap to the egress cap and is circumferentially surrounded by the outer housing along an entire length of the inner sleeve, the length parallel with the central axis of the suppressor. An eleventh example of the suppressor optionally includes one or more of the first through tenth examples, and further includes, wherein the inner sleeve is spaced away from an inner surface of the outer housing along the entire length of the inner sleeve. A twelfth example of the suppressor optionally includes one or more of the first through eleventh examples, and further includes, wherein an upstream end of the inner sleeve proximate to the ingress cap includes a set of cut-outs that extend through a thickness of a wall of the inner sleeve. A thirteenth example of the suppressor optionally includes one or more of the first through twelfth examples, and further includes, wherein the set of cut-outs in the upstream end of the inner sleeve couples an inner chamber of the inner sleeve to an outer chamber formed between an outer surface of the inner sleeve and an inner surface of the outer housing. A fourteenth example of the suppressor optionally includes one or more of the first through thirteenth examples, and further includes, wherein baffles are positioned inside the inner sleeve spaced apart from one another and aligned along a length of the inner sleeve so that spaces between the baffles form baffle chambers.

In another embodiment, a suppressor includes a housing enclosing an inner sleeve and a plurality of baffles, the housing including one or more blowout regions. In a first example of the suppressor, the blowout regions are holes into which plugs are installed, the plugs configured to be expelled when an inner pressure of the suppressor rises above a threshold level. A second example of the suppressor optionally includes the first example, and further includes, wherein cages are coupled to outer surfaces of the housing, the cages surrounding the blowout regions and configured to trap particulate matter ejected through the blowout regions upon rupturing of the blowout regions.

In another embodiment, a firearms system includes a suppressor adapted with blowout panels in surfaces of an outer housing of the suppressor, the blowout panels configured to be first-to-degrade regions to relieve excess pressure. In a first example of the firearms system, the suppressor is formed from a single, unitary material and configured to be 3D-printable.

It should be appreciated that while the suppressor may be unitary in its construction, and thus in a sense virtually all of its components could be said to be in contact with one another, the terms used herein are used to refer to a more proper understanding of the term that is not so broad as to mean simply that the various parts are connected or contacting through a circuitous route because a single unitary material forms the suppressor.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A suppressor, comprising:

a housing enclosing an inner sleeve and a plurality of baffles, the housing including one or more blowout regions, and the one or more blowout regions formed as defined regions integral to one or more walls of the housing, and the defined regions of the one or more blowout regions having a structural irregularity reducing tensile strength of the one or more blowout regions, the structural irregularity not present in the walls outside of the defined regions of the one or more blowout regions, and the one or more blowout regions configured to fail creating an opening in the housing to vent gas.

2. The suppressor of claim 1, wherein the one or more blowout regions are holes into which plugs are installed, the plugs configured to be expelled when an inner pressure of the suppressor rises above a threshold level.

3. The suppressor of claim 1, wherein the suppressor is formed as a single, unitary material and configured to be 3D-printable.

4. The suppressor of claim 1, wherein the one or more blowout regions are formed in an egress end cap of the housing, and a projectile exits through the egress end cap.

5. The suppressor of claim 1, wherein the one or more blowout regions are formed in a side wall of the housing and the side wall connects two end caps of the housing.

6. The suppressor of claim 1, wherein the one or more blowout regions are formed in an egress end cap of the housing, and a projectile exits through the egress end cap, and the one or more blowout regions are formed in a side wall of the housing and the side wall connects the egress end cap and an ingress end cap of the housing.

7. The suppressor of claim 1, wherein the one or more blowout regions are formed on an inner surface of the housing.

8. The suppressor of claim 1, wherein the one or more blowout regions are positioned on a side wall and are positioned closer to an egress cap of the housing than an ingress cap of the housing.

9. A suppressor, comprising:

a housing enclosing a plurality of baffles, the housing including one or more blowout regions;

the one or more blowout regions formed as defined regions integral to one or more walls of the housing, and the defined regions of the one or more blowout regions having a characteristic reducing tensile strength of the one or more blowout regions, the characteristic comprising at least one of a lower thickness, a lower density, or a structural irregularity compared to the walls outside of the defined regions, the one or more blowout regions configured to fail creating an opening in the housing to vent gas, and the walls outside of the defined regions of the one or more blowout regions not having the lower thickness, the lower density, or the structural irregularity.

10. The suppressor of claim 9, wherein two or more of the blowout regions are spaced at a regular interval around the housing.

11. The suppressor of claim 9, wherein the one or more blowout regions have the lower thickness compared to the walls outside of the defined region and the lower thickness is between 10-90% of the walls outside of the defined regions.

12. The suppressor of claim 9, wherein a first of the one or more blowout regions has a different shape from a second of the one or more blowout regions.

13. The suppressor of claim 9, wherein the one or more blowout regions are positioned in an ingress end cap of the housing.

14. The suppressor of claim 9, wherein the one or more blowout regions have a lower tensile strength than the walls outside of the defined regions.

15. A suppressor, comprising:

a housing enclosing a plurality of baffles, the housing including one or more blowout regions;

the one or more blowout regions formed as defined regions integral to one or more walls of the housing, and the defined regions of the one or more blowout regions having a characteristic reducing tensile strength of the one or more blowout regions, the characteristic comprising at least one of a lower thickness, a lower density, a cavity configured to receive a plug structural irregularity, and a different material compared to the walls outside of the defined regions, the one or more blowout regions configured to rupture prior to the walls outside of the defined regions, and the walls outside of the defined regions of the one or more blowout regions not having the lower thickness, the lower density, the structural irregularity, or the different material.

16. A method comprising the suppressor of claim 15, the method comprising:

firing a weapon attached to the suppressor after one or more of the one or more blowout regions has ruptured.

17. The suppressor of claim 15, wherein the one or more blowout regions are formed as cavities configured to receive plugs.

18. The suppressor of claim 15, wherein the one or more blowout regions are formed of a same material as the walls outside of the defined regions.

19. The suppressor of claim 15, wherein the one or more blowout regions are formed in an end of the suppressor where a projectile exits.

* * * * *